US005886986A

United States Patent [19]

Lee et al.

[11] Patent Number: 5,886,986

[45] Date of Patent: Mar. 23, 1999

[54] DUPLEXER HAVING DUAL COUPLED LINE CHARACTERISTICS

[75] Inventors: Chang-Hwa Lee; Meyng-Soo Kim; Bon-Hee Koo; Dong-Suk Jun; Sang-Seok Lee; Tae-Goo Choy, all of Daejeon, Rep. of Korea

[73] Assignees: Electronics and Telecommunications Research Institute, Daejeon; Korea Telecommunication, Seoul, both of Rep. of Korea

[21] Appl. No.: 840,641

[22] Filed: Apr. 25, 1997

[30] Foreign Application Priority Data

Nov. 5, 1996 [KR] Rep. of Korea ..... 1996-52112

[51] Int. Cl.[6] ..... H01P 1/213

[52] U.S. Cl. ..... 370/276; 333/202; 343/909

[58] Field of Search ..... 370/276, 278, 370/282; 333/202, 206, 134, 204; 343/909

[56] References Cited

U.S. PATENT DOCUMENTS

| | | | |
|---|---|---|---|
| 5,144,268 | 9/1992 | Weldman | 333/204 |
| 5,404,120 | 4/1995 | Agahi-Kesheh | 333/206 |
| 5,525,946 | 6/1996 | Tsujiguchi et al. | 333/202 |
| 5,686,873 | 11/1997 | Tada et al. | 333/134 |
| 5,696,473 | 12/1997 | Tsujiguchi et al. | 333/202 |
| 5,712,648 | 1/1998 | Tsujiguchi | 343/909 |
| 5,719,539 | 2/1998 | Ishizaki et al. | 333/204 |

*Primary Examiner*—Chau Nguyen
*Assistant Examiner*—Kenneth Vanderpuye
*Attorney, Agent, or Firm*—Antonelli, Terry, Stout & Kraus, LLP

[57] ABSTRACT

A duplexer having dual coupled line characteristics is disclosed. With a small number of resonators and without using an external device such as a chip inductor or a chip capacitor, the signals of the receiving frequency can be improvingly damped. The diameters of the transmitting terminal dielectric filter resonators and the receiving terminal dielectric filter resonators are not same, but their diameters at an open terminal and at a short circuit terminal are made different from each other so as to differentiate a coupling amount at the short circuit terminal from that at the open terminal. Further, the transmitting terminal filter resonators and the receiving terminal dielectric filter resonator are provided in a form of grooves, and sizes of the grooves near the open terminal are made different from those of the grooves near the short circuit terminal so as to differentiate a coupling amount of the resonators at the short circuit terminal from those at the open terminal. The duplexer of the present invention is used in the transmission/receiving separate type filter of the mobile communication.

5 Claims, 5 Drawing Sheets

DUPLEXER HAVING DUAL COUPLED LINE CHARACTERISTICS

BACKGROUND OF THE INVENTION

1. Field of the Invention

The present invention relates to a duplexer which is a transmitting/receiving separate type filter for use in UHF band mobile communication. In particular, the present invention relates to a duplexer having dual coupled line characteristics.

2. Description of the Prior Art

The duplexer which is used as a transmitting/receiving separate type filter in the UHF band mobile communications uses TEM mode dielectric coaxial resonators. The number of the coaxial resonators is decided depending on the filter requirement characteristics but generally, in order to increase the signal damping for the transmitting frequency at the band pass filter of the receiving terminal, the number of the resonators of the filter of receiving terminal is made larger than that of resonators of the band pass filter of the transmitting terminal.

FIG. 1 illustrates the constitution of a duplexer using the conventional dielectric. In this duplexer, an integrated type is provided in which a plurality of resonators are connected to a single dielectric block. That is, the duplexer includes: four resonators 2 of the transmitting terminal, five resonators 2' of the receiving terminal, and a resonator 3 used as a separating circuit for separating the transmitting/receiving signals.

In a dielectric block 1, the resonators 2, 2' and 3 having holes of the same size are formed from an upper face 1' of the dielectric block to its bottom. Further, the five faces of the dielectric block 1 excluding the upper face 1' are electroplated. Therefore, the resonators form short circuits connected from the bottom of the dielectric block to the ground. The upper face 1' functions as a ¼ resonator which is an open end terminal. Further, the diameters of the resonators are uniform, and therefore, they are uniform impedance resonators in which the impedance of the open terminal is same as that of the short circuit terminal.

Further, in the first resonator and in the last resonator, there are inserted conductive rods 5 as input/output terminals. Further, dielectric sleeves are fitted to the input/output terminal conductive rods 5 for a capacitive coupling between the conductive rods 5 and the resonators 2. Further, resonator 3 is provided for the branching circuit so as to match the impedance between the transmitting terminal and the receiving terminal at an antenna terminal 5'. Therefore, input signals which are inputted into the transmitting filter are not transferred to the receiving filter, but are transmitted through the antenna terminal. The signals which are received through the antenna terminal are transferred to the transmitting filter but are transferred to the receiving terminal.

In this duplexer described above, the coupling between the resonators is done through a single coupling line in which the odd and even mode admittances of the open terminal and short circuit terminal are constant. Further, all the faces of the dielectric block except the upper face 1' are electroplated with a metal.

In the duplexer of FIG. 1, if an electric equivalent circuit is illustrated by using a coupling line for the transmitting filter, then it becomes as shown in FIG. 6. In FIG. 6, the equivalent circuit includes three resonators, and a UIR resonator is shown in the form of a short-circuited ¼-wavelength resonator 19. Further, the coupling between the resonators is shown in the form of a distribution device 20 based on an induced coupling. Further, the coupling between the input/output conductive rods and the resonators is shown in the form of capacitance 21.

In this duplexer, if the insertion loss characteristics are illustrated for the band pass filters used in the transmitting terminal and the receiving terminal, then it becomes FIG. 9 in which the dampings at the frequencies higher or lower than the pass band are almost same.

However, in the mobile communication, in order to efficiently utilize the frequency, the transmitting band and the receiving band are closely positioned. Further, in order to make the damping of the adjacent frequency large, the transmitting band pass filter requires a more superior damping characteristic at a frequency higher than that of the pass band. Further, the band pass filter which is used at the receiving terminal requires a higher damping characteristic at a frequency lower than that of the pass band. In this band pass filter, in order to improve the damping characteristics, if the number of the resonators is increased, the damping characteristics are improved, but the insertion loss is increased, and the bulk of the filter is increased. Accordingly, there is required a pole filter having a blocking pole without transmitting the signals at a particular frequency, and without increasing the number of resonators.

FIG. 2 illustrates another conventional duplexer in which short-circuited ¼-wavelength individual resonators 6 and a concentrated device are used, thereby providing a duplexer having a polarity. A transmitting filter includes three individual resonators, and a chip capacitor 9 is inserted into between a first resonator and input terminal 7. The coupling between the resonators is carried out in such a manner that an electrical pattern is connected on a PCB board 8, and that an external chip capacitor 9 is connected to it. In order to block the transmission of signals at a particular frequency, a separate chip inductor 10 is inserted into an open terminal of a second resonator. The resonance circuit is modified by connecting the chip inductor 10 to the open terminal of the second resonator so as to form a pole frequency. That is, at a frequency at which the impedance of the second resonance circuit becomes zero, the signals from the input side cannot be transferred, but flows through the resonance circuit to the ground, and therefore, there occurs a pole frequency. Such a pole frequency is generated at a frequency higher than the pass band of the transmitting filter, and therefore, the damping of the receiving signals can be increased. The filter of the receiving terminal includes four individual resonators, while a chip capacitor is inserted into between the last resonator and an output terminal. An equivalent circuit for this duplexer is illustrated in FIG. 7.

The equivalent circuit of FIG. 7 includes three resonators. The coupling between the resonators is done in such a manner that an electrical pattern is connected to a PCB board 8, and an external chip capacitor 9 is connected to it. In order to block the transfer of signals at a particular frequency, a separate chip capacitor 10' is disposed at an open terminal of a second resonator. Under this condition, the pole frequency occurs at a frequency lower than that of the pass band of the receiving frequency, and therefore, the damping of the transmitting frequency can be increased.

The frequency characteristics of this filter is illustrated in FIG. 10. In order to match the impedance of the filters of the antenna terminal 7', the transmitting terminal and the receiving terminal, there are used a chip inductor 11 and a chip capacitor 11'. Therefore, the signals which are inputted into the transmitting input terminal are not transmitted to the filter of the receiving terminal due to the impedance adjusting inductor, but are propagated through the antenna terminal to the external. The signals which are received to the antenna terminal are transmitted to the filter of the receiving terminal, thereby transferring energy.

In such a duplexer, a pole filter is formed, and therefore, the damping characteristics can be improved with a small number of resonators. However, external devices such as a chip capacitor or a chip inductor are used, and therefore, the bulk of the product is increased, as well as complicating the manufacturing process.

In the transmitting/receiving separate type filter of the mobile communication, a high damping characteristic is required, and owing to the compactness and light weight trend of the terminals, the filter and duplexer have to be miniaturized. Therefore, a duplexer which is small in size and superior in the damping characteristics is in demand. However, in the conventional duplexer, either the number of the resonators is increased, or an external device such as a chip capacitor or a chip inductor has to be used. Consequently, the size of the filter is increased, and the manufacturing process becomes complicated. Therefore, a duplexer which is superior in the damping characteristics and small in size is in demand.

Recently in the mobile communications, in order to efficiently utilize the frequency, the transmitting and receiving bands are closely approached, while the miniaturization and light weight of the terminals are progressing at a fast pace.

SUMMARY OF THE INVENTION

The present invention is intended to overcome the above described problems of the conventional techniques, and to meet the current trend.

Therefore, it is an object of the present invention to provide a duplexer having dual coupling line characteristics, in which, when manufacturing the duplexer by using a dielectric material, a small size is possible, the damping characteristics are superior even without using an external device, and the manufacturing process is simplified so as to reduce the manufacturing cost.

In achieving the above object, the duplexer as a transmitting/receiving filter for use in mobile communication according to the present invention includes: a dielectric block; transmitting terminal dielectric filter resonators formed in the dielectric block by passing through from the top of the dielectric block to the bottom; receiving terminal dielectric filter resonators; and a resonator for a separating circuit, wherein diameters of the transmitting terminal dielectric filter resonators and the receiving terminal dielectric filter resonators are not the same, but their diameters at an open terminal and at a short circuit terminal are made different from each other so as to differentiate a coupling amount at the short circuit terminal from that at the open terminal.

In achieving the above object, the duplexer as a transmitting/receiving filter for use in a mobile communication according to the present invention includes: a dielectric block; transmitting terminal dielectric filter resonators formed in the dielectric block by passing through from the top of the dielectric block to the bottom; receiving terminal dielectric filter resonators; and a resonator for a separating circuit, wherein the transmitting terminal filter resonators and the receiving terminal dielectric filter resonator are provided in the form of grooves, and sizes of the grooves near the open terminal are made different from those of the grooves near the short circuit terminal so as to differentiate a coupling amount of the resonators at the short circuit terminal from those at the open terminal.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

Figure 1:
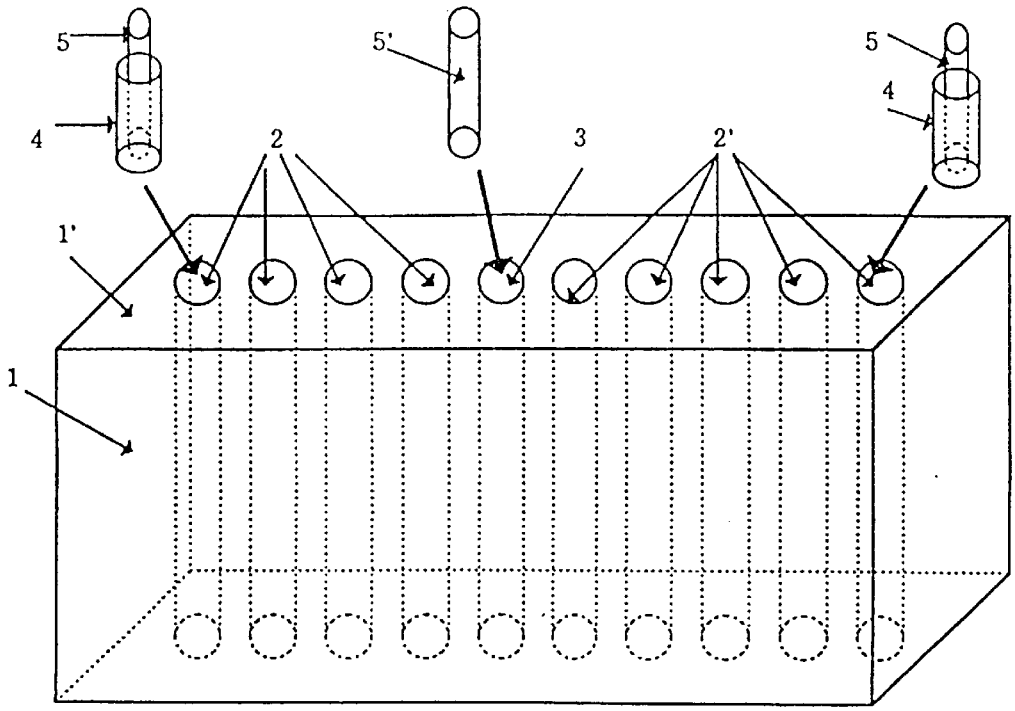
FIG. 1 PRIOR ART
FIG. 1 illustrates the constitution of the filter using a conventional dielectric block.
Figure 2:
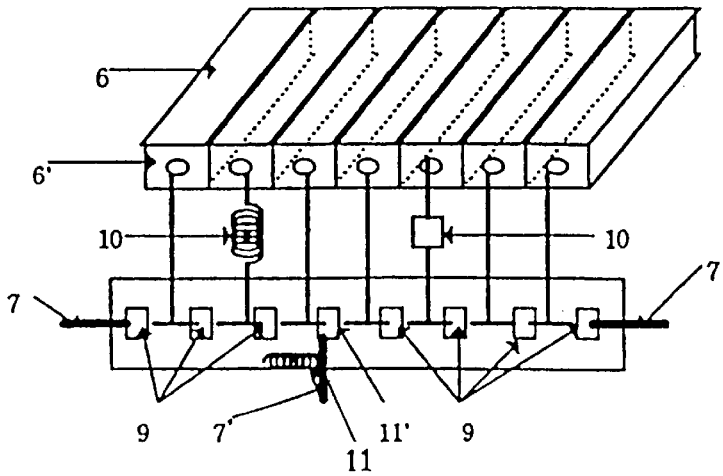
FIG. 2 PRIOR ART
FIG. 2 illustrates the constitution of another filter using a conventional dielectric block.
Figure 3:
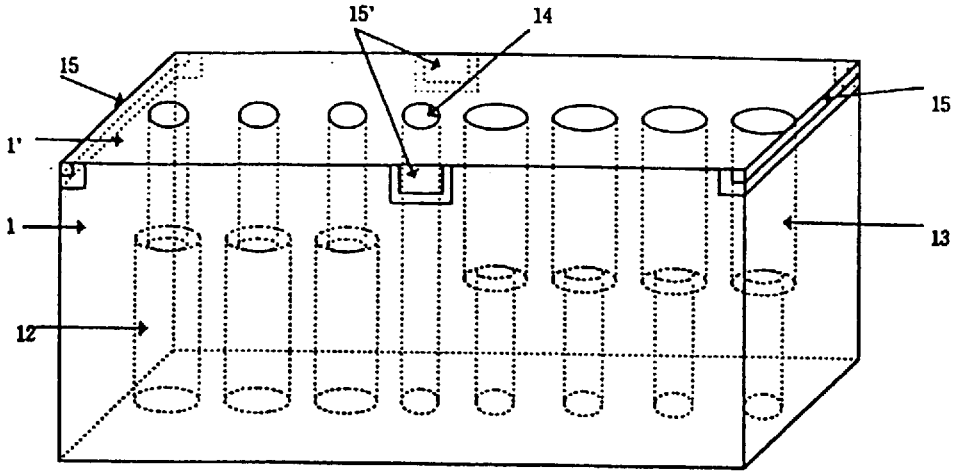
FIG. 3 illustrates the constitution of the filter according to the present invention.

FIG. 3 illustrates the constitution of the filter according to the present invention.

When forming resonators from the top 1' of a dielectric block 1 to the bottom, the diameter of the resonators at the top 1' of the dielectric block is made different from that at the bottom of the dielectric block.

Excluding the top of the dielectric block, all of the faces of the dielectric block are electroplated, and therefore, the top of the dielectric block becomes an open terminal for each of the resonators, while the bottom of the dielectric block becomes a short circuit terminal of the resonators.

Therefore, a transmitting terminal band pass filter resonator 12 is formed such that the diameter of the resonators near the short circuit terminal is made larger than that of the resonators near the open terminal. A receiving terminal band pass filter resonator 13 is formed such that the diameter of the resonator near the open terminal is made larger than that of the resonators near the short circuit terminal. Such a resonator is a stepped impedance resonator (SIR) in which the impedance near the open terminal is different from the impedance near the short circuit terminal. A separating circuit is composed of a uniform impedance resonator (UIR) 14 which is for matching the impedances of the transmitting and receiving filters at the antenna terminal.

Figure 8:
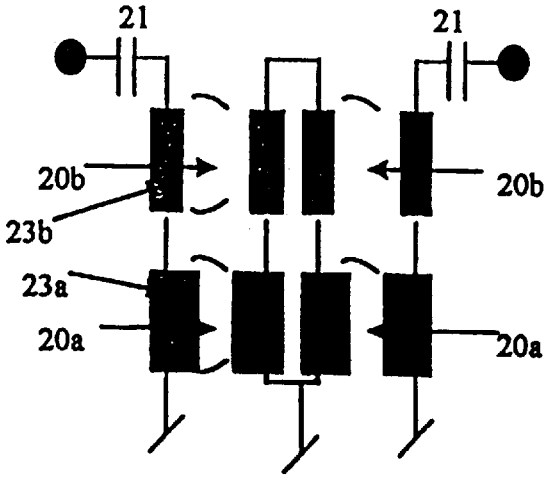
FIG. 8 is an electrical equivalent circuit according to the present invention.
Figure 9:
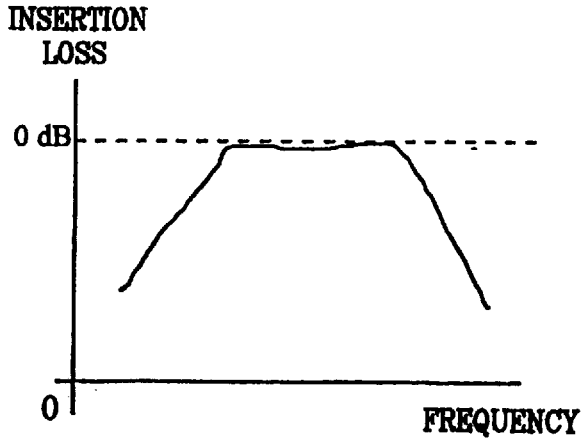
FIG. 9 is a graphical illustration showing the insertion loss versus frequencies of the filters of the transmitting and receiving terminals of FIG. 1.

Antenna terminal electrodes 15' are formed on the front and rear sides of the dielectric block, while input/output terminal electrodes 15 are formed on the left and right sides of the dielectric block but extending slightly to the rear and frontal sides. Looking into the equivalent circuit of the transmitting terminal filter of FIG. 8, the coupling between the resonators are made through a dual coupling line in which two coupling lines 20*a* and 20*b* having different coupling amounts are connected together by means of a cascade. The coupling relationship which resorts to the dual coupling line can be defined in a mathematical formula in the form of an admittance matrix by using odd and even mode admittances:

$$|-j(½)\ y_2[B_0(f)+B_e(f)]-j(½)\ y_2[B_0(f)-B_e(f)]|$$

$$|-j(½)\ y_2[B_0(f)+B_e(f)]-j(½)\ y_2[B_0(f)+B_e(f)]|$$

In the above formula, $Y_2$ is the odd mode admittance of the open terminal part of the resonator, $B_0(f)$ is the susceptance of the SIR resonator which is expressed based on the odd mode admittance, and $B_e(f)$ is the susceptance of the SIR resonator which is expressed based on an even mode admittance.

Therefore, in the double coupling between the SIR resonators, the signals, which are input with a frequency at which the susceptance of the resonator based on the odd mode admittance is same as the susceptance of the resonator based on the even mode admittance, flow to the ground. Therefore, there occurs a pole frequency at which the signals are not transmitted to the output section. This pole frequency can be made to occur at a frequency lower or higher than the pass band frequency by properly adjusting the odd and even mode admittance near the open terminal and the short circuit terminal of the resonator.

Figure 10:
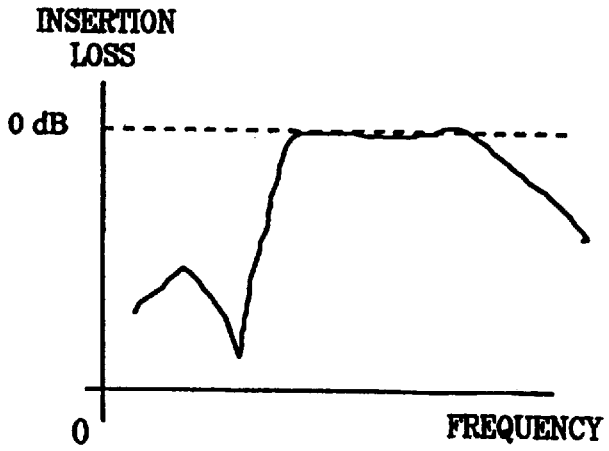
FIG. 10 is a graphical illustration showing the insertion loss versus frequencies of the filters of the receiving terminal of FIG. 2 and of the present invention.

If the diameter of the resonator near the open terminal of the resonator is larger than the diameter of the resonator near the short circuit terminal, then a pole frequency occurs at a frequency lower than the pass band frequency as shown in FIG. 10. On the other hand, if the diameter of the resonator near the short circuit terminal is larger than the diameter of the resonator near the open terminal, then a pole frequency occurs at a frequency higher than the pass band frequency. Therefore, if the duplexer is made by means of a pole existent filter by utilizing a dual coupling line, then the damping characteristics can be improved at a frequency lower and higher than the pass band without using an external device such as a chip inductor or a chip capacitor, and without increasing the number of the resonators.

Therefore, in the duplexer according to the present invention, the band pass filter of the transmitting terminal is formed by means of SIR resonators 12 in which the resonator diameter of the short circuit terminal is larger than the resonator diameter of the open terminal, so that a pole frequency would occur at a frequency higher than the transmitting pass band, thereby increasing the damping of the signals of the receiving frequency. On the other hand, if the band pass filter of the receiving terminal is made by means of the SIR resonators 13 in which the resonator diameter of the open terminal is larger than the resonator diameter of the short circuit terminal, then a pole frequency occurs at a frequency lower than the receiving pass band, so that the signals of the transmitting frequency can be greatly damped.

Therefore, when manufacturing the duplexer, if the resonator diameter of the open terminal is made different from the resonator diameter of the short circuit terminal, a pole frequency can be made to occur at a frequency lower and higher than the pass band frequency. Therefore, the damping characteristics can be improved without using an external device such as a chip inductor or a chip capacitor but by using a small number of the resonators. Further, if the SIR resonators are formed, the length of the resonators can be reduced by properly adjusting the odd and even mode admittances near the open terminal and the short circuit terminal, and therefore, the size of the filter can be reduced.

Electrodes 15' for the antenna terminal are formed on the front and rear faces of the dielectric block, in such a manner that a surface installation should be possible. Electrodes 15 for the input/output terminals of the transmitting/receiving terminals are formed on the left and right faces of the dielectric block, and are slightly extended to the front and rear faces of the dielectric block. In this duplexer, a filter is formed by the dielectric block and an electroplating, and therefore, the manufacturing process is simplified, and the manufacturing cost is reduced.

Figure 4:
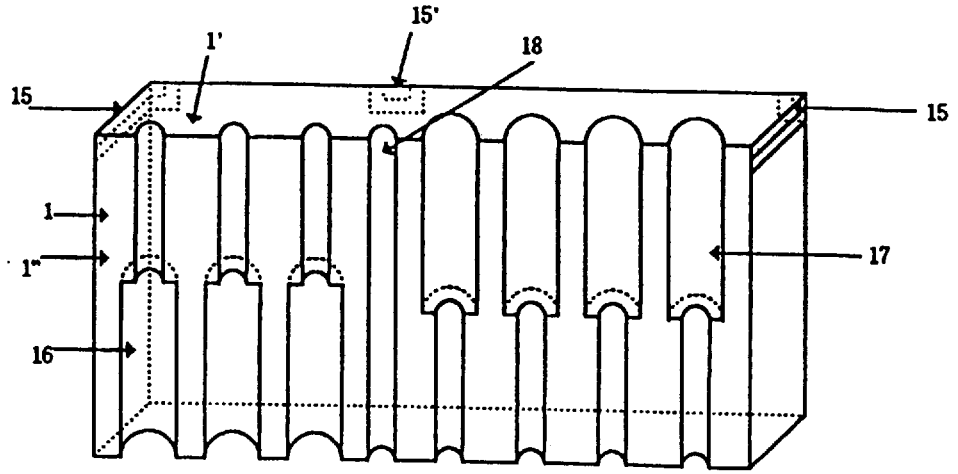
FIG. 4 illustrates the constitution of another embodiment of the filter according to the present invention.

FIG. 4 illustrates the constitution of another embodiment of the filter according to the present invention.

In this embodiment, the resonators are not formed by providing through holes, but by providing grooves 16, 17 and 18. In this duplexer, all of the faces of the dielectric block are electroplated except a top face 1' and a frontal face 1". Thus as in FIG. 3, the top of the dielectric block becomes an open terminal of the resonators. Under this condition, in order to obtain the duplexer effect of FIG. 3 from the grooved resonators, the size of the grooves of the short circuit terminal is made different from the size of the grooves of the open terminal, so that a pole frequency would occur at a frequency higher or lower than the pass band. That is, if the size of the grooves of the open terminal is larger than the size of the grooves of the short circuit terminal, a pole frequency occurs at a frequency lower than the pass band, and therefore, it is suitable for the filter of the receiving terminal. On the other hand, if the size of the grooves of the short circuit terminal is larger than the size of the grooves of the open terminal, then a pole frequency occurs at a frequency higher than the pass band, and therefore, it is suitable for the filter of the transmitting terminal.

Therefore, in such a duplexer, a high damping can be obtained even with a small number of resonators. Further, the height of the duplexer can be reduced so as to miniaturize the terminal of the mobile communication. Further, the manufacturing process is simplified, and therefore, the manufacturing cost can be saved. Further, a surface installation is possible.

Figure 5:
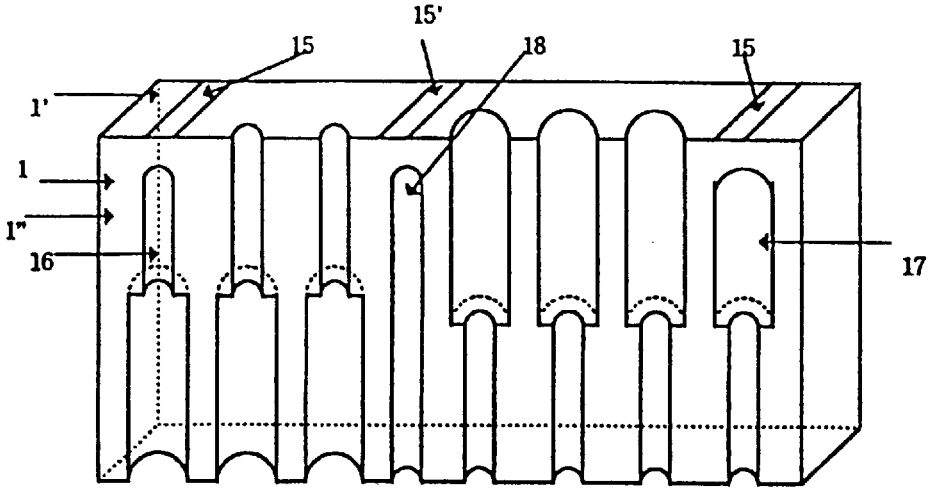
FIG. 5 illustrates the constitution of still another embodiment of the filter according to the present invention.
Figure 6:
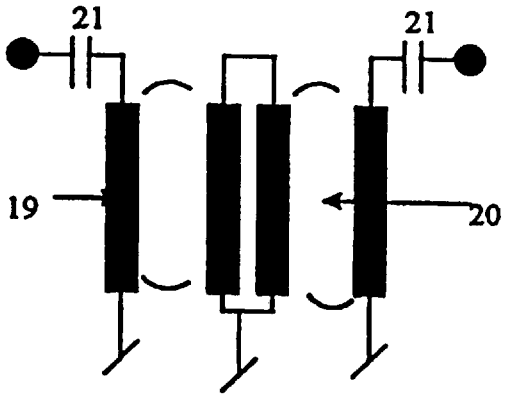
FIG. 6 is an electrical equivalent circuit for FIG. 1.
Figure 7:
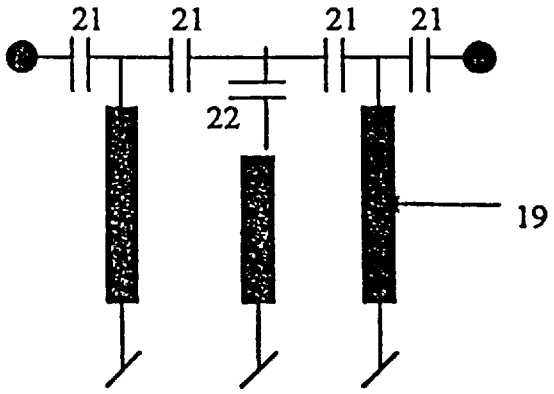
FIG. 7 is an electrical equivalent circuit for FIG. 2.

FIG. 5 illustrates the constitution of still another embodiment of the filter according to the present invention.

As shown in FIG. 5, in a dielectric block having grooved resonators, there are provided an input terminal 15 of a transmitting filter, an antenna terminal 15' and an output terminal 15" of a receiving terminal, in such manner that they are disposed on the top 1' of the dielectric block. Further, a first resonator 16 of the transmitting terminal, a last resonator 17 of the receiving terminal and a resonator 18 for a separating circuit are made not to reach the top of the dielectric block but to end below the top of the dielectric block. Further, the electrodes 15, 15' and 15" are formed on the top of the dielectric block, so that there would be formed a capacitive coupling between the electrodes and the resonators. In this type of the duplexer, all of the faces of the dielectric block are electroplated except the top 1' and the frontal face 1". Further, as in FIG. 4, the size of the grooves near the short circuit terminal is made different from the size of the grooves near the open terminal. Therefore, a pole frequency is formed at a frequency higher or lower than the pass band.

In the duplexer having the above described resonators, high damping can be obtained with a small number of resonators. Further, the height of the duplexer is made low so as to miniaturize the mobile communication terminal. Further, the manufacturing process is simplified, and therefore, the manufacturing cost can be saved. Further, a surface installation is possible.

In the present invention as described above, it should be apparent to those ordinarily skilled in the art that various substitutions, modifications and changes can be added without departing from the scope of the present invention.

According to the present invention as described above, if a duplexer having the dual coupling line is manufactured, the transmitting terminal band pass filter can dispose a pole frequency at a frequency higher than the pass band with a small number of resonators and without using an external device such as a chip inductor or a chip capacitor, and therefore, the signals of the receiving frequency can be improvingly damped. The receiving terminal band pass filter can dispose a pole frequency at a frequency lower than the pass band, thereby improvingly damping the signals of the transmitting frequency. The length of the SIR resonator can be made shorter than that of the UIR resonator, and therefore, the size of the filter can be reduced. Further, the resonators are provided in the form of grooves, so that the height of the duplexer can be reduced, thereby making it possible to miniaturize the duplexer. Further, the input/output terminals and the antenna terminal are disposed on the frontal and rear faces of the dielectric block, or they are disposed on the top of the dielectric block, so that a surface installation would be possible. Further, the duplexer is formed by electroplating the dielectric block, and therefore, the manufacturing process is simplified, and the manufacturing cost is reduced.

Many different embodiments of the present invention may be constructed without departing from the spirit and scope of the invention. It should be understood that the present invention is not limited to the specific embodiments described in this specification. To the contrary, the present invention is intended to cover various modifications and equivalent arrangements included within the spirit and scope of the claims.

What is claimed is:

1. A duplexer as a transmitting/receiving filter for use in mobile communication, having a dual coupling line, comprising:

a dielectric block;

transmitting terminal dielectric filter resonators formed in said dielectric block by passing through from a top of said dielectric block to a bottom thereof;

receiving terminal dielectric filter resonators; and a resonator for a separating circuit, wherein said transmitting terminal filter resonators and said receiving terminal dielectric filter resonator are formed as grooves, and sizes of said grooves near an open terminal are different from sizes of said grooves near a short circuit terminal so as to differentiate a coupling amount of said resonators at said short circuit terminal from those at said open terminal.

2. The duplexer as claimed in claim 1, further comprising:

an antenna terminal drawn on frontal and rear faces of said dielectric block; and input/output terminals formed on two faces of said dielectric block.

3. The duplexer as claimed in claim 1, wherein in the resonators of said transmitting terminal dielectric filter, grooves near said short circuit terminal are larger than grooves near said open terminal so as to render a pole frequency disposed at a frequency higher than a pass band and, in the resonators of said receiving terminal dielectric filter, grooves near said short circuit terminal are smaller than grooves near said open terminal so as to render a pole frequency disposed at a frequency lower than a pass band.

4. The duplexer as claimed in claim 1, wherein a part of the plurality of said resonators does not extend to the top of said dielectric block but stops below the top of said dielectric block, and input/output electrodes and an antenna electrode are formed at the remaining top portions of said dielectric block so as to form capacitive couplings between said electrodes and said resonators.

5. The duplexer as claimed in claim 4, wherein, in the resonators of said transmitting terminal dielectric filter, grooves near said short circuit terminal are larger than grooves near said open terminal so as to render a pole frequency disposed at a frequency higher than a pass band and, in the resonators of said receiving terminal dielectric filter, grooves near said short circuit terminal are smaller than grooves near said open terminal so as to render a pole frequency disposed at a frequency lower than a pass band.

* * * * *